US006276571B1

(12) United States Patent
Clemmons

(10) Patent No.: US 6,276,571 B1
(45) Date of Patent: Aug. 21, 2001

(54) FUEL DISPENSING SYSTEM

(76) Inventor: Kody Clemmons, 815 Arkansas Ave., Lynn Haven, FL (US) 32444

( * ) Notice: Subject to any disclaimer, the term of this patent is extended or adjusted under 35 U.S.C. 154(b) by 0 days.

(21) Appl. No.: 09/595,008

(22) Filed: Jun. 16, 2000

(51) Int. Cl.[7] ..... B67D 5/60

(52) U.S. Cl. ..... 222/464.2; 222/464.3; 222/481.5; 222/482

(58) Field of Search ..... 222/464.2, 464.3, 222/481.5, 482

(56) References Cited

U.S. PATENT DOCUMENTS

| | | | | |
|---|---|---|---|---|
| 440,205 | * | 11/1890 | Smith | 222/482 X |
| 4,328,909 | * | 5/1982 | Jeans | 222/481.5 X |
| 4,441,533 | | 4/1984 | Snyder et al. . | |
| 5,232,110 | * | 8/1993 | Purnell | 222/481.5 X |
| 5,301,846 | * | 4/1994 | Schmitz | 222/481.5 X |
| 5,343,738 | | 9/1994 | Skaggs . | |
| 5,405,058 | * | 4/1995 | Kalis et al. | 222/481.5 X |
| 5,609,192 | | 3/1997 | Anderson et al. . | |
| 5,853,114 | * | 12/1998 | Giovanoli | 222/481.5 X |
| 5,971,042 | | 10/1999 | Hartsell, Jr. . | |

* cited by examiner

*Primary Examiner*—Kenneth Bomberg
(74) *Attorney, Agent, or Firm*—William B. Noll

(57) ABSTRACT

A portable fluid dispensing system, such as for the transfer of fuel to a vehicle fuel tank, that is convenient and safe. The system hereof includes a closed fluid containing chamber, having access means for fitting the chamber, air relief means, and a quantity regulating dispensing mechanism. The quantity regulating dispensing mechanism includes a pair of concentric tubular members, rotatable relative to one another, where such members feature a series of apertures or ports that may be aligned, through rotation of one of the members, to control the quantity of fluid to be dispensed at any given time, such as in increments of gallons.

9 Claims, 2 Drawing Sheets

Fig. 1
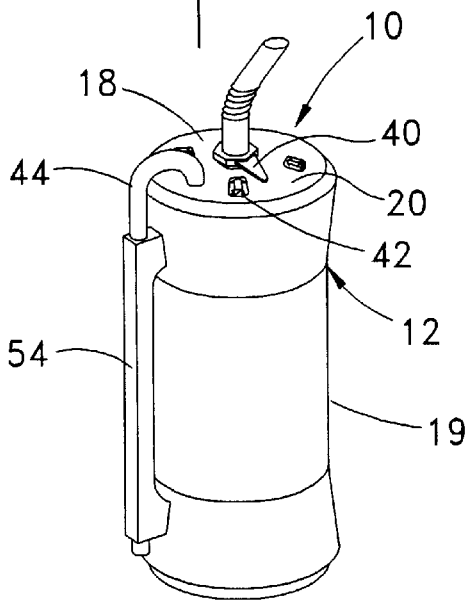
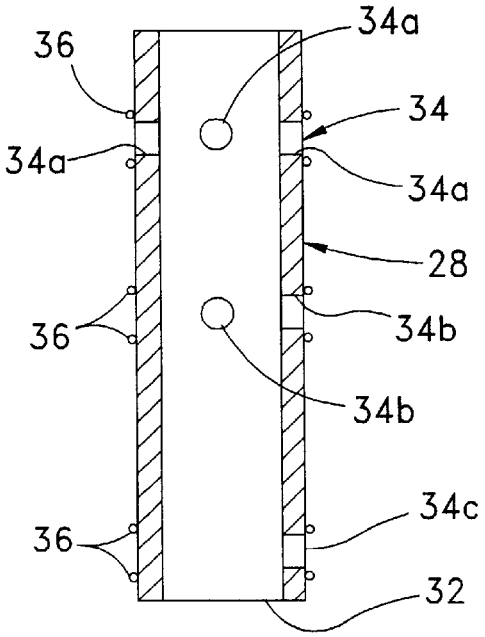
Fig. 4
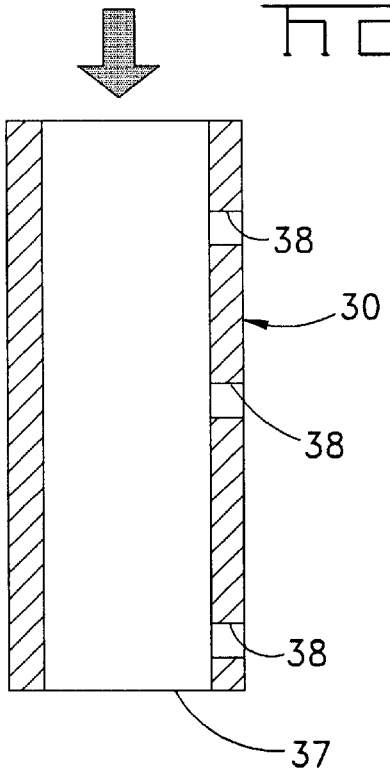
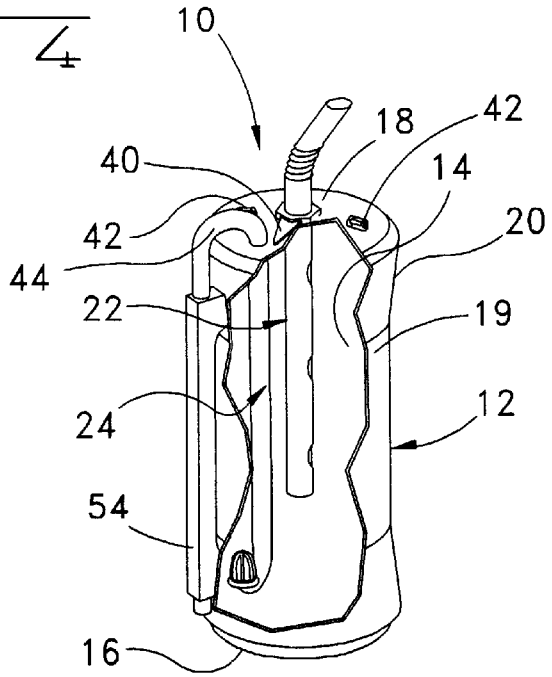
Fig. 2

FUEL DISPENSING SYSTEM

FIELD OF THE INVENTION

This invention is directed to the field of portable fluid dispensing systems, more particularly to a rapid, no spill fuel dispensing system that includes an easy regulator mechanism to control the quantity of fuel to be dispensed at any given time.

BACKGROUND OF THE INVENTION

The present invention relates preferably to a system for the rapid transfer of fuel, for example, to a vehicle's fuel tank in a fast and convenient manner. Transferring fuel from a portable container to a vehicle fuel tank can often result in spillage and the potential of fire where the engine is hot and in close proximity to the fuel tank. Add to this the desire and need for a rapid transfer, such as in racing cars and 4-wheelers, or quads, conventional portable containers offer neither the speed nor safety required in the transfer process.

The prior art, in its recognition for the need for safety in transferring fuel from one location to another, has devised a number of complex schemes to effectively make such transfer. Such complex schemes are reflected in the following U.S. patents:

a.) U.S. Pat. No. 4,441,533, to Snyder, et al., teaches an automatic fuel dispensing system including an automatic dispensing nozzle similar to dispensing nozzles which open manually to dispense liquids and shut-off automatically when tanks such as locomotive fuel tanks near the point of being filled, or for closing an automatic shut-off valve when the dispensing valve is a substantial distance from the tank being filled. The automatic dispensing system is provided with an atmospheric pressure balanced diaphragm and an internal vacuum conduit where the diaphragm operates the shut-off valve when reduced air pressure from the vacuum conduit interrupts the pressure balance of the diaphragm. The tank to be filled is provided with an air conduit connected to the internal vacuum conduit of the automatic dispensing nozzle to operate the cut-off of the nozzle to a point adjacent the outer opening of the tank fill pipe when fuel enters the air conduit. Mounted in the fill pipe of the tank is a fill pipe adapter which cooperates with the nozzle spout of the automatic dispensing nozzle to create a vacuum chamber between the inserted nozzle spout and the adapter wall. To satisfy the vacuum demand of the automatic shut-off valve, the nozzle spout extends into the fill pipe adapter a sufficient distance to provide a narrow opening between the end of the spout and the adapter wall such that when liquid is dispensed from the nozzle spout, air is removed from the vacuum chamber creating a partial vacuum for operating the shut-off valve.

b.) U.S. Pat. No. 5,343,738, to Skaggs, relates to a double walled hose assembly including an elongate inner hose and an elongate outer hose enclosing the inner hose. Both the inner and outer hoses are flexible and made of a resilient material. The inner hose includes a fluid resistant inner layer, a tie layer encircling the inner layer and a reinforcing braid layer encircling the tie layer. An outer layer encircles the tie layer and the reinforcing braid such that the reinforcing braid is embedded between the tie layer and the outer layer. The outer hose is also made from a resilient material such that the outer hose is flexible. At least one rib extends between the inner hose and the outer hose. The at least one rib is secured to at least one of the inner hose and the outer hose and is made from a resilient material such that the rib is flexible. In this way, the hose assembly can be bent as necessary. The hose serves as a fluid transfer hose in a piping system for conveying a fluid from an outlet port of a pump to an inlet port of an above-ground fluid dispenser. A sensor wire may be provided between the two hoses to sense the presence of a fluid such as a fuel.

c.) U.S. Pat. No. 5,609,192, to Anderson, et al., is a fuel dispensing nozzle and a method utilizing that dispensing nozzle. The method comprises the steps of providing a sealing means effective to mate in a sealing relationship with a fuel tank inlet, the sealing means comprising a boot having an elastomeric sealing surface, a source of pressurized gas, a channel providing communication from the source of pressurized gas to outside of the boot wherein pressure on the elastomeric sealing surface restricts flow through the channel, and a means to block fuel flow through the fuel dispensing nozzle when a threshold pressure or greater exists at the source of gas supply, the threshold pressure indicative of a sealing relationship between the sealing surface of the boot and a fuel tank inlet, mating the sealing surface to the fuel tank inlet; and passing fuel into the fuel tank only when the pressure within the gas supply conduit exceeds the threshold pressure.

d.) U.S. Pat. No. 5,971,042, to Hartsell, Jr, teaches a fuel dispenser for a dispensing system having a receiver capable of receiving fueling parameters transmitted from the vehicle. The fueling parameters relate to information about tank size, ullage, maximum allowed fueling rates and maximum fueling rates as a function of ullage, among others. Based on these fueling parameters, the fuel dispenser controls the fueling operation to optimize fuel delivery and minimize fuel spillage. Control of the fueling operation may vary from simply adjusting the delivery rate to a maximum allowed by the vehicle to defining a fueling schedule for the entire fueling operation wherein the fueling schedule defines a fueling process which varies flow rates throughout the fueling operation as necessary to optimize fueling. Additionally, the dispenser may continuously adjust the maximum fueling rate throughout the fueling operation based upon a fueling parameter defining the maximum fueling rate as a function of ullage. The dispenser may also control the fueling operation based on fueling parameters received from the vehicle in combination with fueling regulations mandated by various regulatory bodies. In such embodiments, the dispenser may optimize the fueling operation while abiding by both vehicular and regulatory limitations, such as maximum allowable delivery rates and predefined average fuel rates for all or various portions of the fueling operation.

There is clearly a need for safety in the transfer of fuels, and when coupled with a rapid transfer, the concerns are compounded, particularly in a portable device. The above prior art offers no help in achieving such goals. However, the present invention provides an effective system that is both safe and speedy. The manner by which the invention hereof meets such needs will become apparent in the description which follows.

SUMMARY OF THE INVENTION

This invention is directed to a portable fluid dispensing system for the rapid transfer of fluid, such as fuel, from a first location to a second location. The system comprises a closed fluid containing chamber consisting of a top wall, bottom wall and side wall, with means to fill the chamber with said fluid, means for transferring fluid therefrom, and air relief means to access air to displace the transferred fluid. The transfer means, in its preferred form, comprises a circular spout of a first diameter extending through the top wall in fluid communication with one of a pair of concentric tubular members axially disposed within the chamber. The free or distal ends are in communication with the fluid. To regulate the quantity flow of fluid, the concentric tubular members are adapted to rotate relative to one another, where the outer tubular member has at least a first, second and third aligned ports along its length. The cooperating inner tubular member has a single complementary port aligned with the first port, a pair of complementary ports aligned with the second port, and three complementary ports aligned with the third port. By this arrangement, selected ports may be opened by simple rotation to control the quantity of dispensing fluid. Finally, the air relief means includes a valve automatically closeable during a fluid non-transfer mode, where the air relief means may include a generally circular tube, having a diameter at least 30% of the spout diameter, in communication with the fluid containing chamber, where the external portion of the circular tube may be partially encased by the handle. To minimize internal leakage along the concentric tubular members, the concentric tubular members may be separated by plural pairs of elastomeric type O-rings, where for each aligned port there is an O-ring above and an O-ring below each aligned port.

Accordingly, an object of this invention is to provide a portable container, particularly for the transfer of a fuel, that can be accomplished both rapidly and safely without undo spillage.

Another object hereof is the provision of a dispensing mechanism that incorporates a pair of relatively rotatable concentric tubular members to control the quantity of fluid, i.e. fuel, to be dispensed at any given time.

A further object of the invention is the use of a floating ball valve that automatically closes during a non-dispensing mode to ensure no fumes escape to the atmosphere and the resulting hazards associated therewith.

Still another object of the system hereof is the provision of a convenient external lever that may be rotated to control the dispensing rate and quantity.

These and other objects will become more apparent from the specification which follows, especially to those skilled in the art, particularly when read in conjunction with the accompanying drawings.

BRIEF DESCRIPTION OF DRAWINGS

FIG. 1 is a perspective view illustrating the portable fluid dispensing system of this invention, showing the system in a transportation or non-dispensing mode.

FIG. 2 is a perspective view similar to FIG. 1, with a portion of the chamber wall removed to illustrate certain internal details.

FIG. 4 is an enlarged, exploded sectional view of the pair of concentric tubular members forming a part of the fluid dispensing mechanism for regulating the quantity of fluid to be dispensed from the system.

DETAILED DESCRIPTION OF PREFERRED EMBODIMENT

Figure 3:
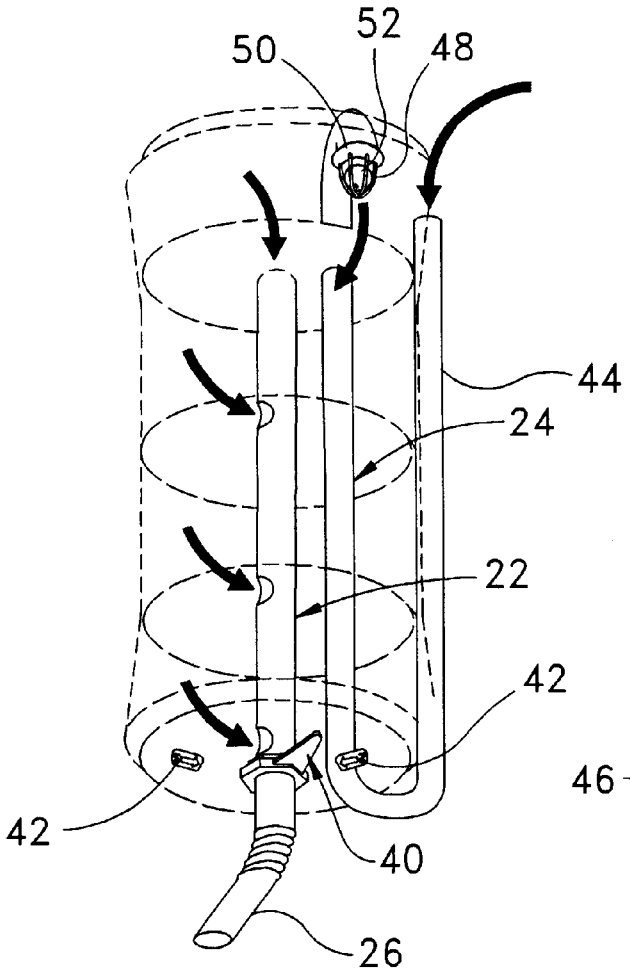
FIG. 3 is a perspective view illustrating the fluid dispensing mode, showing internal details with the chamber wall shown in phantom.

The present invention is directed to a portable fluid dispensing system, preferably a safe and efficient system for transferring fuel to the fuel tank of a variety of diverse vehicles, from mowers to 4-wheelers to racing cars. A feature thereof is an efficient system that minimizes spillage while allowing for a rapid transfer. The system of this invention will now be described with regard to the several Figures, where like reference numerals represent like components or features throughout the various views.

Turning first to FIGS. 1 and 2, there is illustrated the portable system 10, embodying the features of this invention, which comprises an enclosed container 12, having a fluid containing chamber 14. The container 12 is defined by a base 16, a top wall 18 and surrounding side wall 19, extending therebetween. The system further includes an access means along the top wall 18, such as a threaded cap 20, as known in the art, to fill the chamber 14. Further, in fluid communication with the chamber 14, also through the top wall 18, is a fluid transfer mechanism 22. A final feature of the system 10 is an air relief means 24, preferably through the top wall 18, to allow air to readily displace the dispensing fluid.

The fluid transfer mechanism 22, as best illustrated in FIGS. 3 and 4, comprises a flexible spout 26, having a predetermined first diameter, through which the fluid exits the chamber, as explained later. In fluid flow communication with said spout 26 are a pair of concentric tubular members 28, 30, where FIG. 4 shows such members separated for the convenience of illustration, whereas FIG. 3 shows such members in the assembled and operable mode. In any case, the inner tubular member 28, open at its distal end 32, is characterized by a series of apertures 34 at spaced apart locations along the body of the tubular member 28. The uppermost apertures 34A, three in number, are spaced about 90 degrees apart, or by reference to a clock at 3, 6 and 9 o'clock. The intermediate apertures 34B, two in number, are positioned at 3 and 6 o'clock. Finally, the lowest aperture 34C, only one in number, is positioned at 3 o'clock. The significance of the arrangement of apertures will become clearer hereafter. A final feature of the inner tubular member 28 is the provision of plural pairs of O-rings 36, where one of a pair is positioned above and one below the respective sets of apertures, see FIG. 4.

The outer tubular member 30, sized to slidably and rotatably receive the inner tubular member 28, preferably features an open end 37 and three aligned apertures 38, positioned for reference purposes at 3 o'clock, where the apertures 38 will be aligned respectively with apertures 34A, 34B, and 34C in the assembled position shown in FIG. 3. In the assembled position, by means to be described later, the inner tubular member 28 may be rotated relative to the outer tubular member 30 whereby to selectively align apertures to control the quantity of fluid to be dispensed from the chamber 14. To facilitate this relative rotative movement, an external lever 40, along the top wall 18, may be provided. Additionally, appropriate indicia 42 may be printed on or otherwise affixed to the top wall to visually indicate the relative positions of the respective tubular members.

Figure 5:
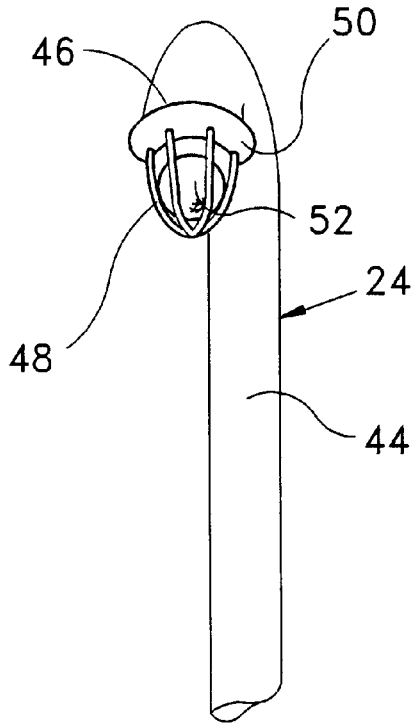
FIG. 5 is an enlarged, partial perspective view showing the air relief valve in the fluid dispensing mode.

Finally, air relief means 24, preferably in the form of a circular tube 44 and extending through the top wall 18 into the chamber 14, see FIGS. 2 and 3, is provided. To ensure adequate air displacement to the system, the circular tube 44 should have a diameter of at least 30% of said first diameter to minimize turbulence in the dispensing flow. As best illustrated in FIG. 5, the free end 46 of the circular tube 44, exposed within the chamber 14, preferably features a cage 48 extending from a donut-shaped member 50 secured to the free end 46. Disposed within said cage 48 and movable relative to said donut-shaped member 50 is a floating ball 52 which is free of said member 50 during a fluid dispensing mode (FIGS. 3 and 5), while seating on the member 50 during periods of transportation or non-use (FIG. 2). By this arrangement, the air relief means is closed during such non-use to prevent fumes, such as in the case of fuels, from escaping from the chamber 14. Since the circular tube 44 is preferably flexible, such as made of plastic, for convenience it may be encased within an elongated handle 54, affixed to the outside of side wall 19.

While a primary feature of the system of this invention is its ability to rapidly dispense the fluid, i.e. fuel, with little or no spillage, another important feature is the ability to control the quantity of dispensing fluid. For example, with an exemplary chamber volume of four gallons, the user may desire to dispense only a single gallon. In such a situation, with a fill chamber, and again referring to the reference to a clock, the two tubular members 28, 30 are aligned at 12 o'clock, that is, no apertures aligned so that fluid is dispensed only through the open distal end 32, spaced one-quarter distance from the bottom wall or base 16. To dispense an additionally gallon, the setting would be at 9 o'clock to thus align aperture 34A to its corresponding aperture 38 on outer tubular member 30. In all cases, the desired setting is visually accomplished by rotating the lever 40 to the appropriate indicia 42. A 3 o'clock setting will obviously allow dispensing of all the remaining fluid.

It is recognized that changes, variations and modifications may be made to the system of this invention without departing from the spirit and scope thereof, especially when considered by those skilled in the art. Accordingly, no limitation is intended to be imposed thereon except as set forth in the accompanying claims.

What is claimed is:

1. A portable fluid dispensing system for the rapid transfer of fluid from a first location to a second location, the system comprising a closed fluid containing chamber consisting of a top wall, bottom wall and side wall, with means to fill said chamber with said fluid, means for transferring fluid therefrom, and air relief means to access air to displace the transferred fluid;

a.) said transfer means comprising a circular spout of a first diameter extending through said top wall in fluid communication with one of a pair of concentric tubular members axially disposed within said chamber having distal ends in communication with said fluid, where said concentric tubular members are adapted to rotate relative to one another, the outer of said concentric tubular member having at least a first, second and third aligned ports along its length, with the inner of said concentric tubular member having a single complementary port aligned with said first port, a pair of complementary ports aligned with said second port, and three complementary ports aligned with said third port, whereby said tubular members may be rotated to align and open selected ports; and, b.) said air relief means comprising a valve automatically closeable during a fluid non-transfer mode.

2. The portable fluid dispensing system according to claim 1, further including an elongated handle, and said air relief means includes a generally circular tube in communication with said fluid containing chamber, where externally said circular tube is partially encased by said handle.

3. The portable fluid dispensing system according to claim 2, wherein the diameter of said circular tube is at least 30% of said first diameter.

4. The portable fluid dispensing system according to claim 1, wherein said concentric tubular members are separated by plural pairs of O-rings, where for each said aligned port there is an O-ring above and an O-ring below each said aligned port.

5. The portable fluid dispensing system according to claim 1, including means along the exterior of said top wall to incrementally rotate one of said tubular members.

6. The portable fluid dispensing system according to claim 5, where said means comprises a rotating lever, with indicia along said top wall to identify which of the ports of said inner tubular member are aligned with a complementary port of said outer tubular member.

7. The portable fluid dispensing system according to claim 2, wherein said circular tube within said fluid containing chamber is J-shaped with a remote end thereof mounting a cage mechanism containing a floating ball to close said end during a fluid non-transfer mode.

8. The portable fluid dispensing system according to claim 7, wherein said cage mechanism includes a donut-shaped member about said end, where said floating ball seats within said donut shaped member.

9. The portable fluid dispensing system according to claim 1, wherein said circular spout is flexible to adjust the angle of fluid discharge.

* * * * *